US007179239B2

(12) United States Patent
Chang

(10) Patent No.: US 7,179,239 B2
(45) Date of Patent: Feb. 20, 2007

(54) LOWER LEG MASSAGE ASSEMBLY

(76) Inventor: Horng Jiun Chang, P.O. Box 63-99, Taichung (TW) 406

( * ) Notice: Subject to any disclaimer, the term of this patent is extended or adjusted under 35 U.S.C. 154(b) by 350 days.

(21) Appl. No.: 10/810,397

(22) Filed: Mar. 25, 2004

(65) Prior Publication Data

US 2005/0215927 A1 Sep. 29, 2005

(51) Int. Cl.
*A61H 23/02* (2006.01)
*A61H 7/00* (2006.01)

(52) U.S. Cl. ..... 601/90; 601/93; 601/98; 601/103; 601/133; 601/134

(58) Field of Classification Search ..... 601/89, 601/90, 92, 93, 94, 95, 133, 98, 100, 101, 601/103, 134, 136
See application file for complete search history.

(56) References Cited

U.S. PATENT DOCUMENTS 6,213,962 B1 * 4/2001 Shimizu ..... 601/90
6,629,940 B2 10/2003 Shimizu ..... 601/133
7,004,916 B2 * 2/2006 Dehli ..... 601/99
7,041,070 B2 * 5/2006 Hsieh ..... 601/90
2004/0171972 A1 * 9/2004 Shimizu et al. ..... 601/99
2004/0186399 A1 * 9/2004 Tseng ..... 601/112

FOREIGN PATENT DOCUMENTS

JP 406245965 A * 9/1994
JP 406245966 A * 9/1994
JP 406245967 A * 9/1994
JP 409266934 A * 10/1997
JP WO99/56694 11/1999

* cited by examiner

*Primary Examiner*—Danton DeMille

(57) ABSTRACT

A lower leg massage device includes a rotatable shaft having two actuating pins, two actuating devices solidly secured on the shaft, and two rotatable actuating devices rotatably attached onto the shaft and each having two opposite seats for selectively engaging with the actuator pins of the shaft. Four massage members are attached onto and to be vibrated by the actuating devices. The actuator pins may selectively engage with the one of the seats to rotate the rotatable actuating devices in one direction, and may engage with the other seat to rotate the rotatable actuating devices in the other direction, and to allow the massage members to be arranged either opposite to or parallel to each other.

1 Claim, 7 Drawing Sheets

LOWER LEG MASSAGE ASSEMBLY

BACKGROUND OF THE INVENTION

1. Field of the Invention

The present invention relates to a lower leg massage assembly, and more particularly to a lower leg massage assembly having massage members changeable to different inclination relative to each other.

2. Description of the Prior Art

Various kinds of typical massage devices have been developed and provided for massaging various portions of users, and comprise a pair of massage members rotatable or driven by a motor, to massage such as the back portions of the users.

For example, an international or a PCT patent application No. WO99/56694 to Shimizu discloses one of the typical massage devices comprising a pair of massage members rotatable or driven by a motor, to massage the back portions of the users. However, Shimizu may not be used to massage the lower legs of the users.

The other typical lower leg massage devices comprise two pairs of massage members rotatable or driven by a motor, to massage the lower legs of the users.

For example, U.S. Pat. No. 6,629,940 to Shimizu one of the typical massage devices comprising two pairs of massage members for massaging the lower legs of the users. For allowing the massage members to suitably massage the lower legs of the users, a cam device is further required to move the massage members toward each other, and thus to allow the lower legs of the users to be suitably massaged by the massage members.

However, the massage members of the typical lower leg massage devices may only be moved toward and away from each other, but may not be changed to different inclination relative to each other, such that the lower legs of the users also may not be suitably massaged by the massage members.

The present invention has arisen to mitigate and/or obviate the afore-described disadvantages of the conventional lower leg massage devices.

SUMMARY OF THE INVENTION

The primary objective of the present invention is to provide a lower leg massage assembly including a massage device having two pairs of massage members that may be changed to different inclination relative to each other, in order to conduct different massaging operations.

In accordance with one aspect of the invention, there is provided a lower leg massage assembly comprising a base, a shaft rotatably supported on the base, two actuating pins attached onto the shaft and rotated in concert with the shaft, two first actuating devices secured on the shaft and rotated in concert with the shaft, two second actuating devices rotatably attached onto the shaft, each of the second actuating devices including a first and a second seats oppositely provided thereon, for selectively engaging with the actuator pins of the shaft respectively, and for allowing the second actuating devices to be rotated and driven by the shaft, and two first and two second massage members attached to the first and the second actuating devices respectively, and arranged to be vibrated by the actuating devices respectively. Each of the first and the second actuating devices includes at least one inclined surface formed therein, to engage with the massage members respectively, and to retain the massage members on the shaft in suitable inclination. The actuator pins of the shaft are provided to engage with the first seats of the second actuating devices respectively and to rotate the second actuating devices in a first direction when the shaft is rotated in the first direction, and the actuator pins of the shaft are provided to engage with the second seats of the second actuating devices respectively and to rotate the second actuating devices in a second direction when the shaft is rotated in the second direction, and to allow the second massage members to be selectively arranged either opposite to or parallel to the first massage members respectively.

Each of the second actuating devices includes a hub provided thereon to rotatably support the shaft, and the first and the second seats are oppositely provided and extended from the hub. The hub preferably includes a semi-circular structure.

Each of the actuating devices includes a first and a second sandwich plates engaged onto and secured to the massage members respectively. Each of the massage members includes an opening formed therein, each of the first sandwich plates of the actuating devices includes a bulge extended therefrom and engaged through the opening of the massage members respectively to stably retain the massage members between the first and the second sandwich plates of the actuating devices respectively.

Two pads may further be provided and engaged between the first and the second massage members respectively, to receive lower legs of users.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
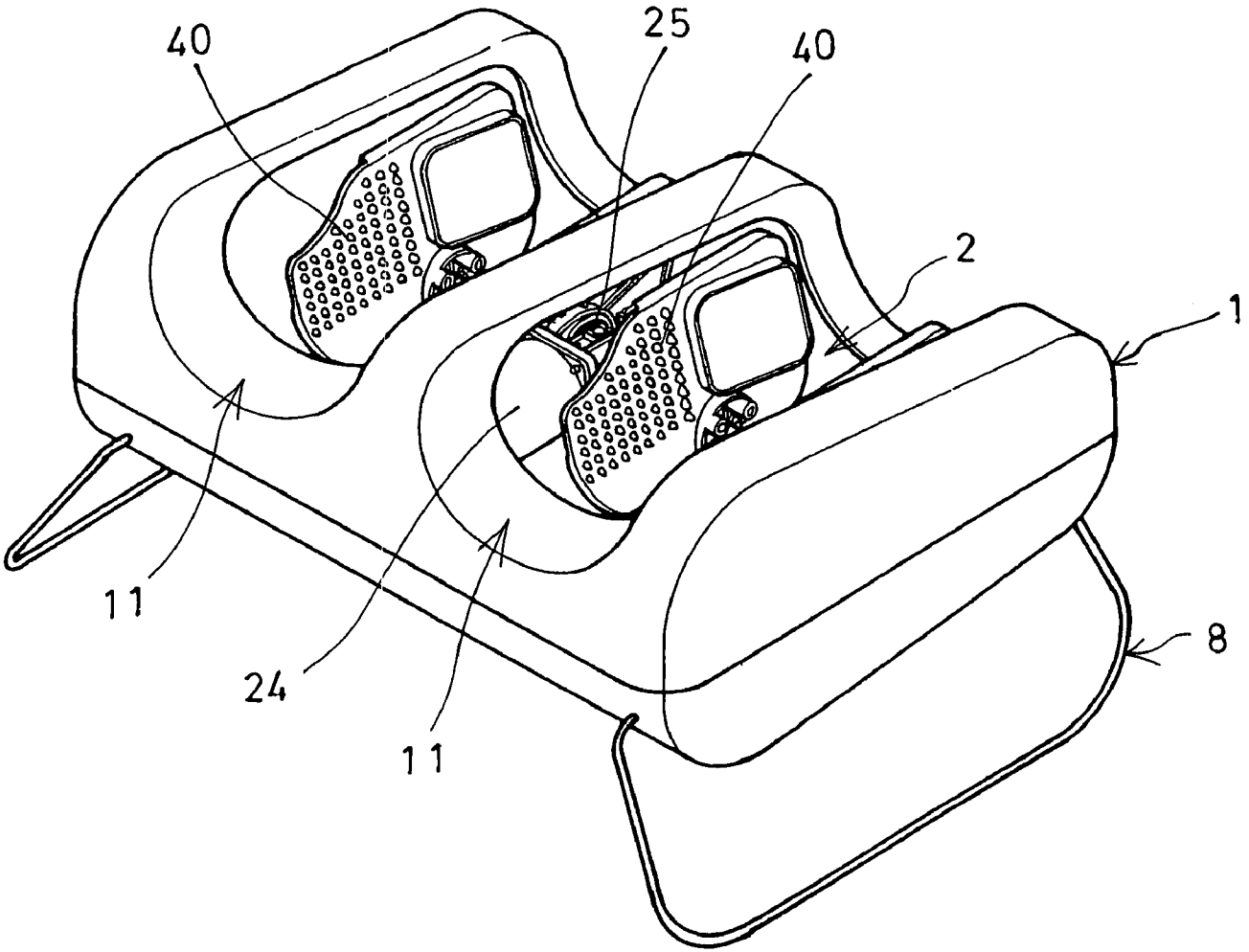
FIG. 1 is a perspective view of a lower leg massage assembly in accordance with the present invention.

Referring to the drawings, and initially to FIGS. 1–5, a lower leg massage assembly in accordance with the present invention comprises a housing 1 including two recesses 11 formed therein to receive lower legs of users, and a massage device 2 received in the housing 1 and having two pairs of massage members 40 to suitably massage the lower legs of the users.

Figure 8:
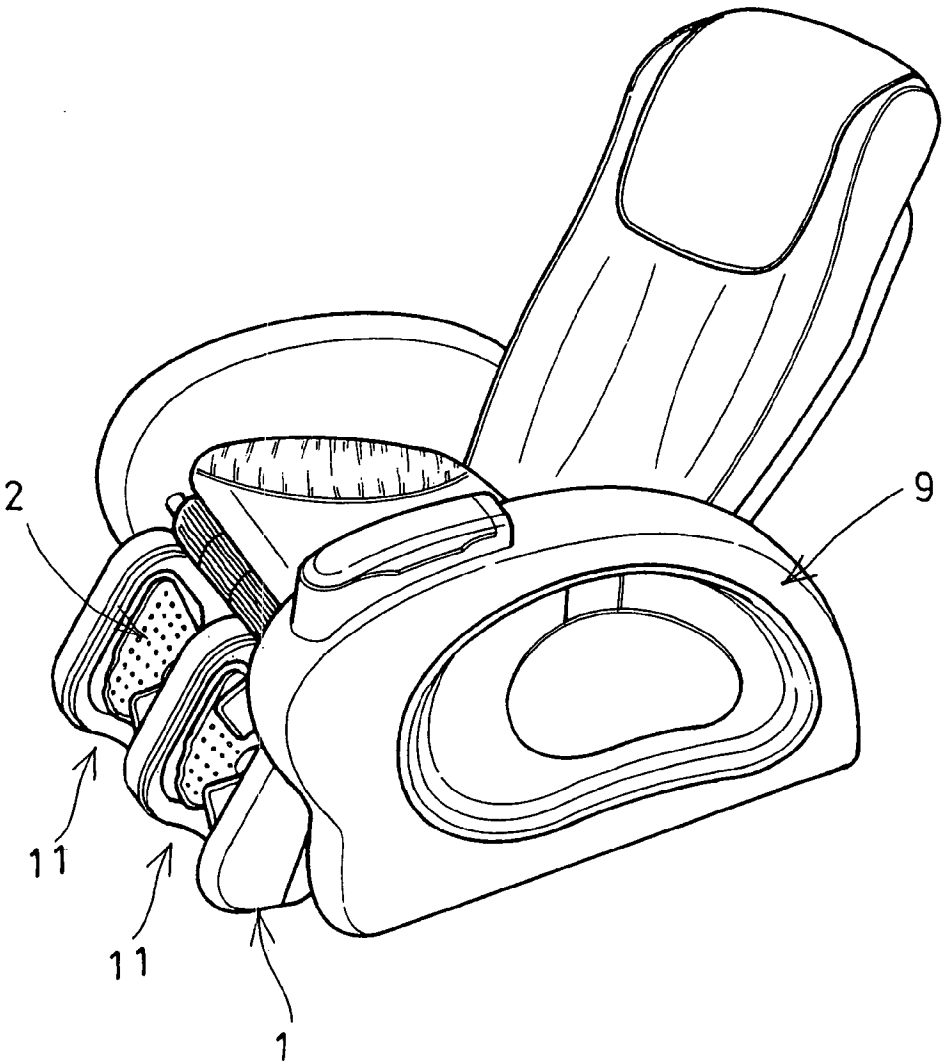
FIG. 8 is a perspective view illustrating the other application of the lower leg massage assembly.

A stand 8 may further be provided to support the housing 1, and to suitably receive the lower legs of the users. Alternatively, as shown in FIG. 8, the housing 1 may be disposed or engaged in a lower portion of a chair 9 or the like, to allow the lower legs of the users to be suitably engaged into the recesses 11 of the housing 1, and thus to be suitably massaged by the massage device 2.

Figure 2:
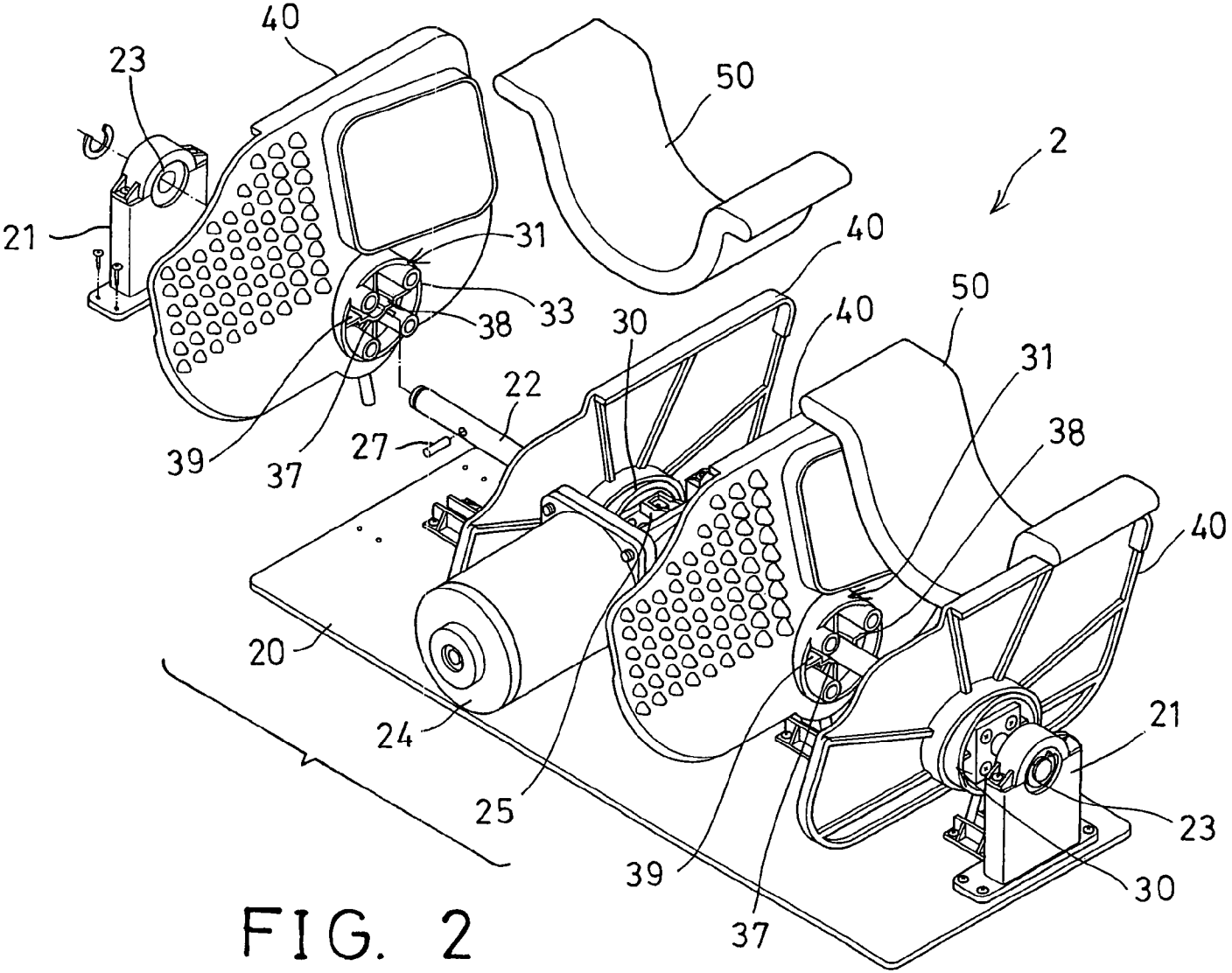
FIG. 2 is a partial exploded view of the lower leg massage device.

As shown in FIG. 2, the massage device 2 includes a base 20 having two supports 21 provided thereon or extended therefrom, to rotatably support a shaft 22 thereon with such as bearings 23. A motor 24 may be disposed on the base 20, and coupled to the shaft 22 with such as a reduction gearing 25, to rotate or drive the shaft 22. Two actuator pins 27 are attached onto the shaft 22 (FIGS. 2, 5), and rotated in concert with the shaft 22.

Two pairs of actuating devices 30, 31 are attached onto the shaft 22, and each pair of the actuating devices 30, 31 may include one or a first actuating device 30 solidly secured onto the shaft 22 and rotated in concert with the shaft 22, and the other or a second actuating device 31 rotatably attached onto the shaft 22. The massage members 40 are attached to the two pairs of actuating devices 30, 31 respectively, and to be actuated or vibrated by the actuating devices 30, 31 respectively.

Figure 3:
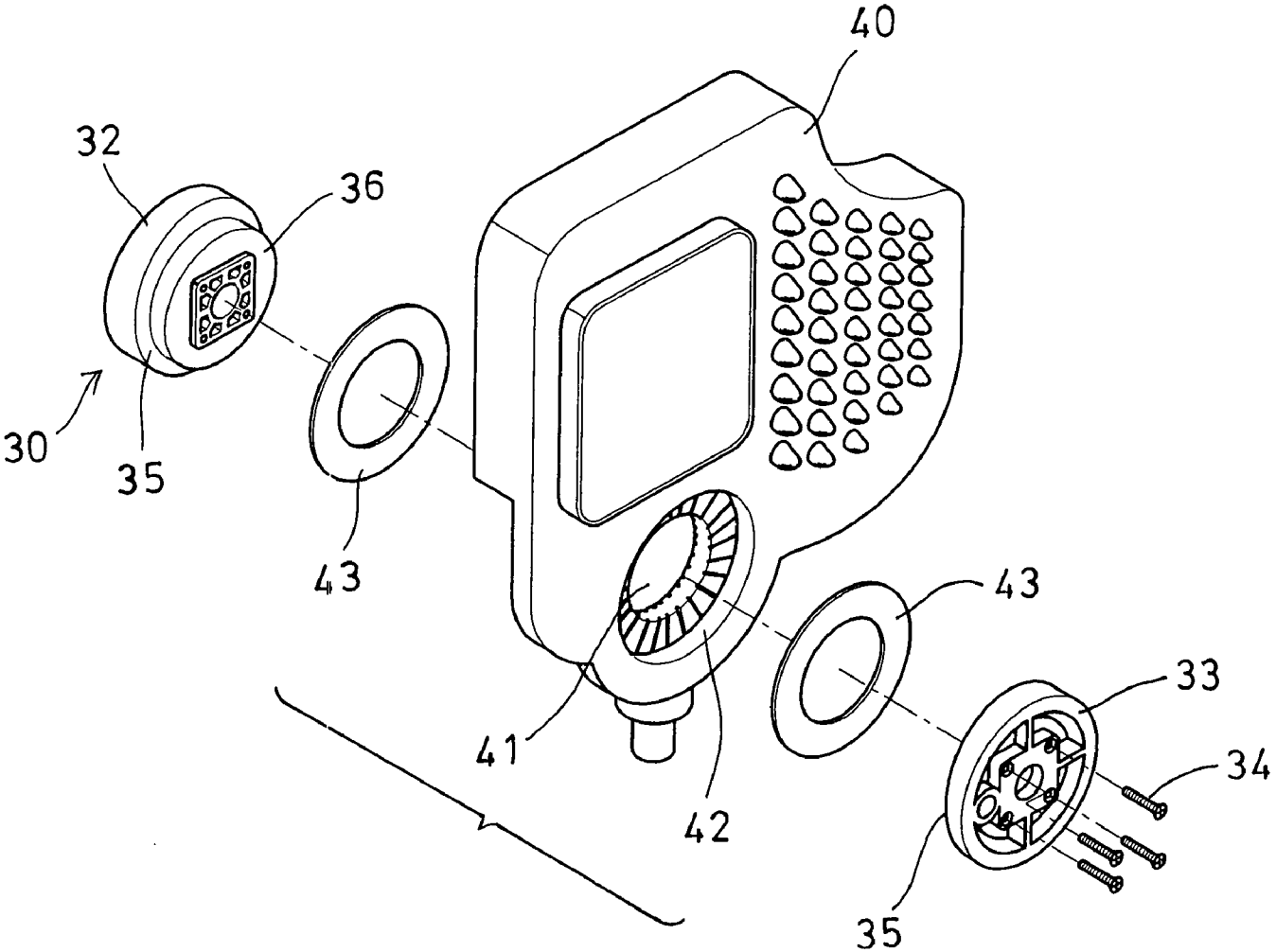
FIG. 3 is another partial exploded view of the lower leg massage device.
Figure 4:
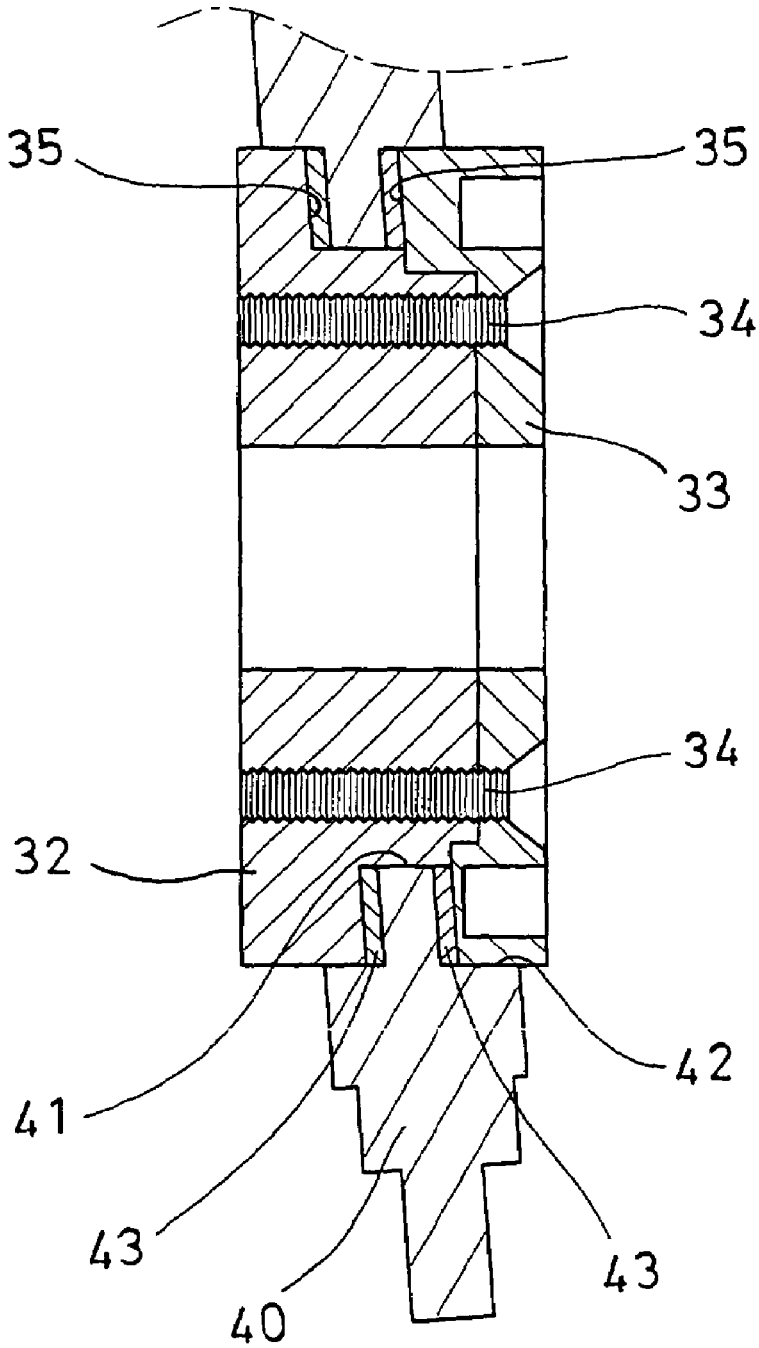
FIG. 4 is a partial cross sectional view of the massage member for the lower leg massage device.

As shown in FIGS. 3 and 4, each of the actuating devices 30, 31 includes two sandwich plates 32, 33 secured together with such as fasteners 34, and each having an inclined surface 35 formed therein and parallel to each other (FIG. 4). One of the sandwich plates 32 may include a bulge 36 rotatably engaged through an opening 41 of the massage member 40, and the massage member 40 may include a peripheral depression 42 formed therein to rotatably receive the other sandwich plate 33, and thus to allow the sandwich plates 32, 33 to be rotatably secured to the massage members 40.

As best shown in FIG. 4, the inclined surfaces 35 of the sandwich plates 32, 33 are engaged with the massage members 40, to support the massage members 40 in suitable or predetermined inclination on the shaft 22. Two gaskets 43 may further be provided and engaged between the sandwich plates 32, 33 and the massage members 40, to allow the sandwich plates 32, 33 to be smoothly rotated relative to the massage members 40.

In operation, the sandwich plates 32, 33 of the actuating devices 30, 31 may be rotated or driven by the shaft 22 and the motor 24, and the massage members 40 may thus be actuated to swing relative to each other (FIG. 6), and thus to suitably massage the lower legs of the users. The above described structure of the lower leg massage assembly is typical and will not be described in further details.

Figure 5:
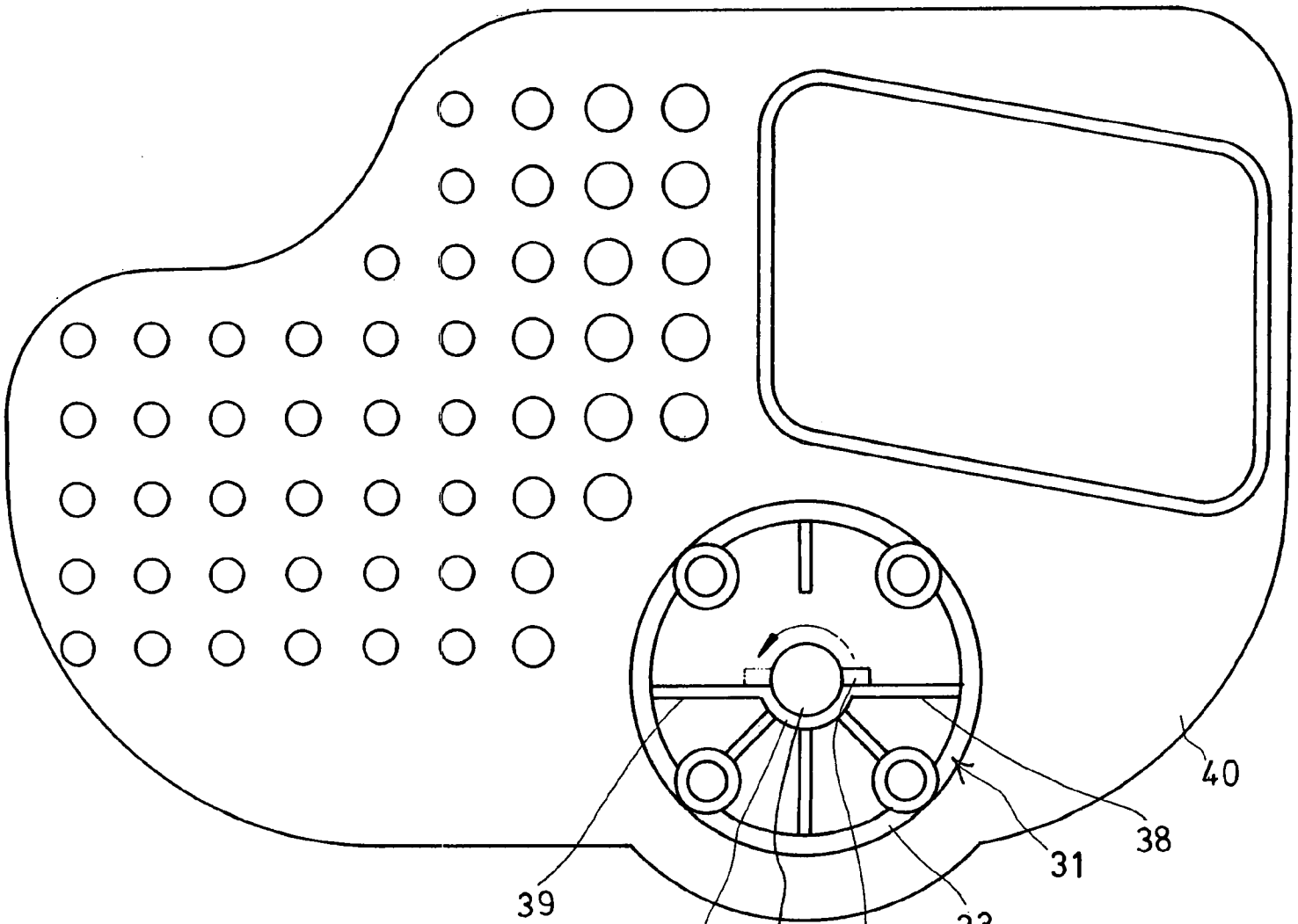
FIG. 5 is a plan view of the massage member for the lower leg massage device.

As shown in FIGS. 2 and 5, it is to be noted that the other actuating devices 31 of the pairs of actuating devices 30, 31 are rotatably attached onto the shaft 22, and each includes a semi-circular hub 37 formed or provided in one or both of the sandwich plates 32, 33 thereof, and each includes two seats 38. 39 formed or provided thereon and disposed on opposite sides of the hub 37, and preferably spaced away from each other for 180 degrees, for engaging with the actuator pins 27 of the shaft 22 respectively.

Figure 6:
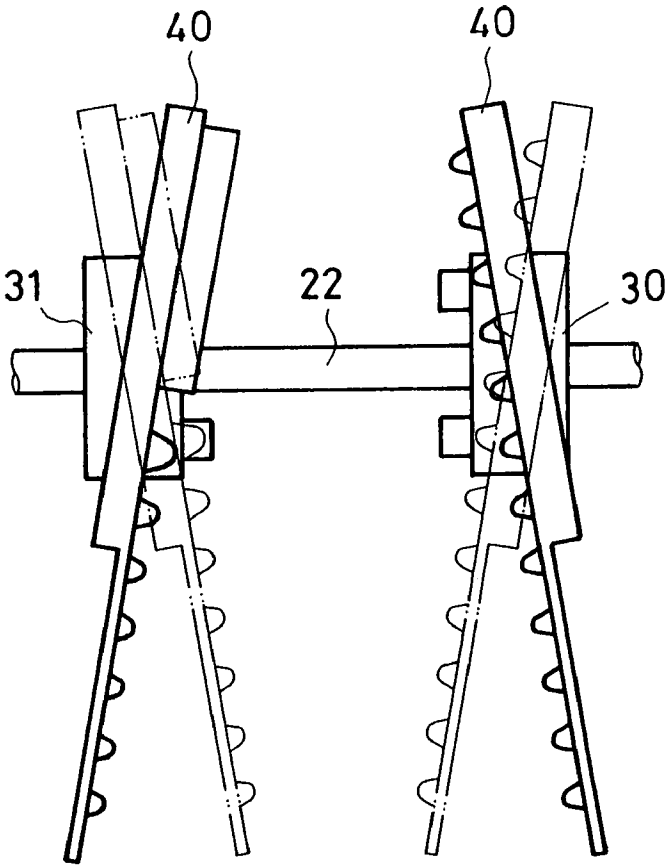
FIGS. 6, 7 are partial plan schematic views illustrating the operation of the massage member for the lower leg massage device.

In operation, when the shaft 22 is rotated or driven in one or in an active direction by the motor 24, such as in a clockwise direction as shown in FIG. 5, the actuator pin 27 may be caused to engage with one of the seats 38 of the actuating device 31, as shown in solid lines in FIG. 5, to allow the massage members 40 driven by the actuating device 31 to be inclined relative to the shaft 22 in different angular directions as the massage members 40 driven by the other actuating devices 30, as shown in FIG. 6.

Figure 7:
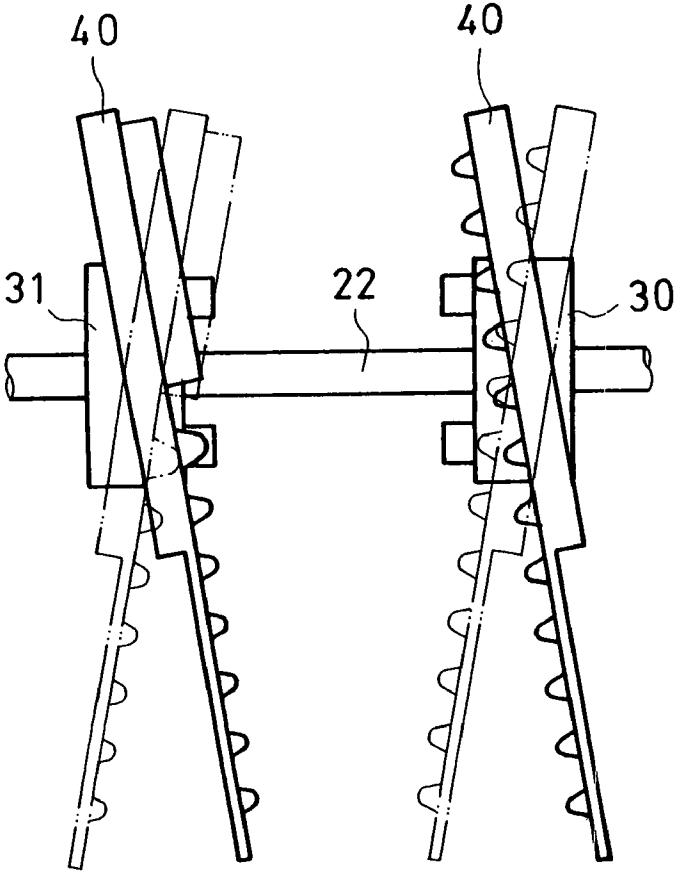

On the contrary, when the shaft 22 is rotated or driven in the other or the reverse direction by the motor 24, such as in a counter-clockwise direction as shown in FIG. 5, the actuator pin 27 may be caused to engage with the other seat 39 of the actuating device 31, as shown in dotted lines in FIG. 5, to allow the massage members 40 driven by the actuating device 31 to be inclined relative to the shaft 22 in the same angular directions as the massage members 40 driven by the other actuating devices 30, or to allow the massage members 40 to be parallel to each other, as shown in FIG. 7.

The massage members 40 may thus be arranged opposed to each other in different inclinations (FIG. 6), or parallel to each other and in the same inclination (FIG. 7), to massage the lower legs of the users in different massaging operations.

As shown in FIG. 2, two spongy or resilient pads 50 may further be provided and received in the recesses 11 of the housing 1 respectively, and engaged between the two pairs of massage members 40 to suitably receive the lower legs of the users, and to allow the lower legs of the users to be suitably or comfortably or resiliently massaged by the massage members 40.

Accordingly, the lower leg massage assembly in accordance with the present invention includes a massage device having two pairs of massage members that may be changed to different inclination relative to each other, in order to conduct different massaging operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lower leg massage assembly comprising:

a base, a shaft rotatably supported on said base, two actuating pins attached onto said shaft and rotated in concert with said shaft, two first actuating devices secured on said shaft and rotated in concert with said shaft, two second actuating devices rotatably attached onto said shaft, each of said second actuating devices including a hub provided thereon and having a semi-circular structure to rotatably support said shaft, each of said second actuating devices including a first and a second seats oppositely provided thereon, for selectively engaging with said actuator pins of said shaft respectively, and for allowing said second actuating devices to be rotated and driven by said shaft, and said first and said second seats being oppositely provided and extended from said hub, two first and two second massage members attached to said first and said second actuating devices respectively, and arranged to be vibrated by said first and said second actuating devices respectively, each of said first and said second massage members including an opening formed therein, each of said first and said second actuating devices including a first and a second sandwich plates engaged onto and secured to said first and said second massage members respectively, each of said first sandwich plates of said first and said second actuating devices including a bulge extended therefrom and engaged through said opening of said first and said second massage members respectively to stably retain said first and said second massage members between said first and said second sandwich plates of said first and said second actuating devices respectively, each of said first and said second actuating devices including at least one inclined surface formed therein, to engage with said massage members respectively, and to retain said massage members on said shaft in suitable inclination, said actuator pins of said shaft being provided to engage with said first seats of said second actuating devices respectively and to rotate said second actuating devices in a first direction when said shaft is rotated in the first direction, and said actuator pins of said shaft being provided to engage with said second seats of said second actuating devices respectively and to rotate said second actuating devices in a second direction when said shaft is rotated in the second direction, and to allow said second massage members to be selectively arranged either opposite to or parallel to said first massage members respectively, and two pads engaged between said first and said second massage members respectively, to receive lower legs of users.

* * * * *